US011597072B2

(12) United States Patent
Ting Ya

(10) Patent No.: US 11,597,072 B2
(45) Date of Patent: Mar. 7, 2023

(54) LENGTH ADJUSTABLE CONNECTION STRUCTURE

(71) Applicant: Huang Ting Ya, Taichung (TW)

(72) Inventor: Huang Ting Ya, Taichung (TW)

( * ) Notice: Subject to any disclaimer, the term of this patent is extended or adjusted under 35 U.S.C. 154(b) by 208 days.

(21) Appl. No.: 17/111,519

(22) Filed: Dec. 4, 2020

(65) Prior Publication Data

US 2021/0316438 A1 Oct. 14, 2021

(30) Foreign Application Priority Data

Apr. 9, 2020 (TW) ..... 109204132

(51) Int. Cl.

| | |
|---|---|
| ***B25G 1/04*** | (2006.01) |
| ***B25B 15/00*** | (2006.01) |
| ***B25B 23/00*** | (2006.01) |
| ***B25B 15/02*** | (2006.01) |

(52) U.S. Cl.

CPC ..... *B25G 1/043* (2013.01); *B25B 15/004* (2013.01); *B25B 23/0042* (2013.01); *B25B 15/02* (2013.01)

(58) Field of Classification Search

CPC ..... B25G 1/04; B25G 1/043; B25B 15/02; B25B 15/004

See application file for complete search history.

(56) References Cited

U.S. PATENT DOCUMENTS

| | | | | |
|---|---|---|---|---|
| 8,307,743 | B2 * | 11/2012 | Hsu | B25G 1/043 81/177.2 |
| 9,718,174 | B2 * | 8/2017 | Tsai | B25G 1/043 |
| 2010/0326248 | A1 * | 12/2010 | Owoc | B25G 1/043 81/177.2 |

* cited by examiner

*Primary Examiner* — David B. Thomas

(57) ABSTRACT

A length adjustable connection structure contains: an adjustment assembly, an engagement assembly, and a receiving tube. The receiving tube includes an insertion accommodated, a coupling portion, a groove, a trench, and an elongated slot. The engagement assembly includes a fixing portion, a toothed portion, a fitting portion, a hexagonal hole, and a circular hole. The adjustment assembly includes a connector, a locating orifice, a hexagonal column, and a C-retainer. The hexagonal column of the adjustment assembly is received in the hexagonal hole of the engagement assembly so that the engagement assembly is connected on the hexagonal column, the C-retainer is engaged in the notch of the hexagonal column, and the adjustment assembly and the engagement assembly are accommodated in the receiving tube, hence the toothed portion of the fixing portion is engaged in the groove of the coupling portion, and the fitting portion is fixed in the trench.

4 Claims, 4 Drawing Sheets

LENGTH ADJUSTABLE CONNECTION STRUCTURE

FIELD OF THE INVENTION

The present invention relates to a length adjustable connection structure which is capable of extending the adjustment assembly in a maximum length or a minimum length.

BACKGROUND OF THE INVENTION

A conventional connection tool is applicable for an electric screwdriver or a pneumatic screwdriver in a limited space. However, the connection tool is too long to portable inconveniently.

The present invention has arisen to mitigate and/or obviate the afore-described disadvantages.

SUMMARY OF THE INVENTION

The primary aspect of the present invention is to provide a length adjustable connection structure which is capable of extending the adjustment assembly in a maximum length or a minimum length.

To achieve above-mentioned aspect, a length adjustable connection structure provided by the present invention contains: an adjustment assembly, an engagement assembly, and a receiving tube.

The receiving tube includes an insertion accommodated in a first end thereof, a coupling portion formed on a second end of the receiving tube and having a diameter more than a diameter of the receiving tube, a groove defined in the coupling portion, a trench extending in the groove and away from the coupling portion, and an elongated slot defined in the trench.

The engagement assembly includes a fixing portion formed on a first end thereof, a toothed portion adjacent to the fixing portion, a fitting portion formed on a second end of the engagement assembly away from the fixing portion, a hexagonal hole extending from the fixing portion, and a circular hole extending from the hexagonal hole to the fitting portion. A diameter of the fixing portion is more than a diameter of the toothed portion, and the diameter of the toothed portion is more than a diameter of the fitting portion.

The adjustment assembly includes a connector, a locating orifice defined in the connector, a hexagonal column extending away from the connector, a notch surrounding an outer end of the hexagonal column, and a C-retainer engaged in the notch.

The hexagonal column of the adjustment assembly is received in the hexagonal hole of the engagement assembly so that the engagement assembly is connected on the hexagonal column, the C-retainer is engaged in the notch of the hexagonal column, and the adjustment assembly and the engagement assembly are accommodated in the receiving tube, hence the toothed portion of the fixing portion is engaged in the groove of the coupling portion, and the fitting portion is fixed in the trench, thus connecting the adjustment assembly, the engagement assembly, and the receiving tube.

DETAILED DESCRIPTION OF THE PREFERRED EMBODIMENTS

Figure 1:
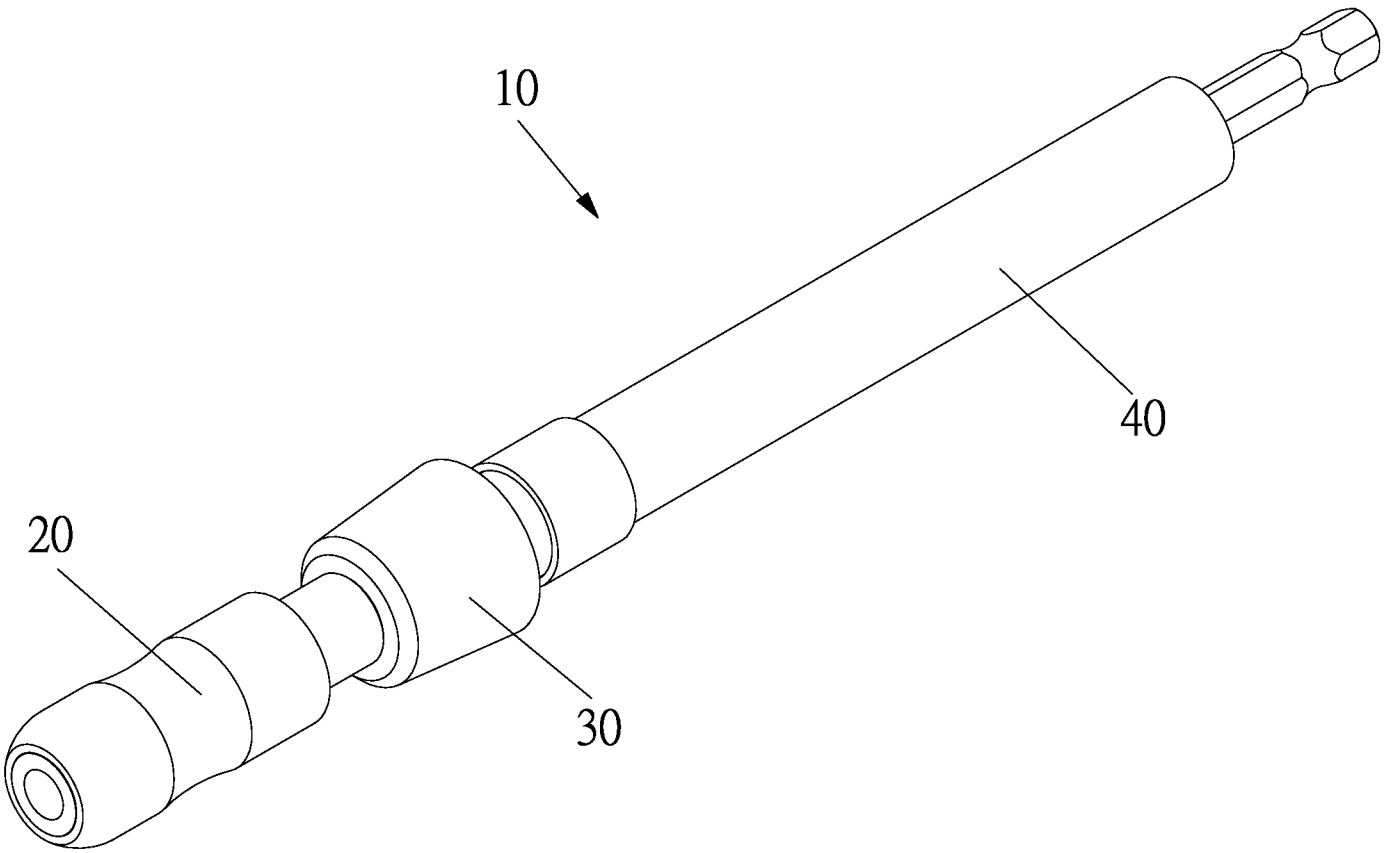
FIG. 1 is a perspective view showing the assembly of a length adjustable connection structure according to a preferred embodiment of the present invention.
Figure 2:
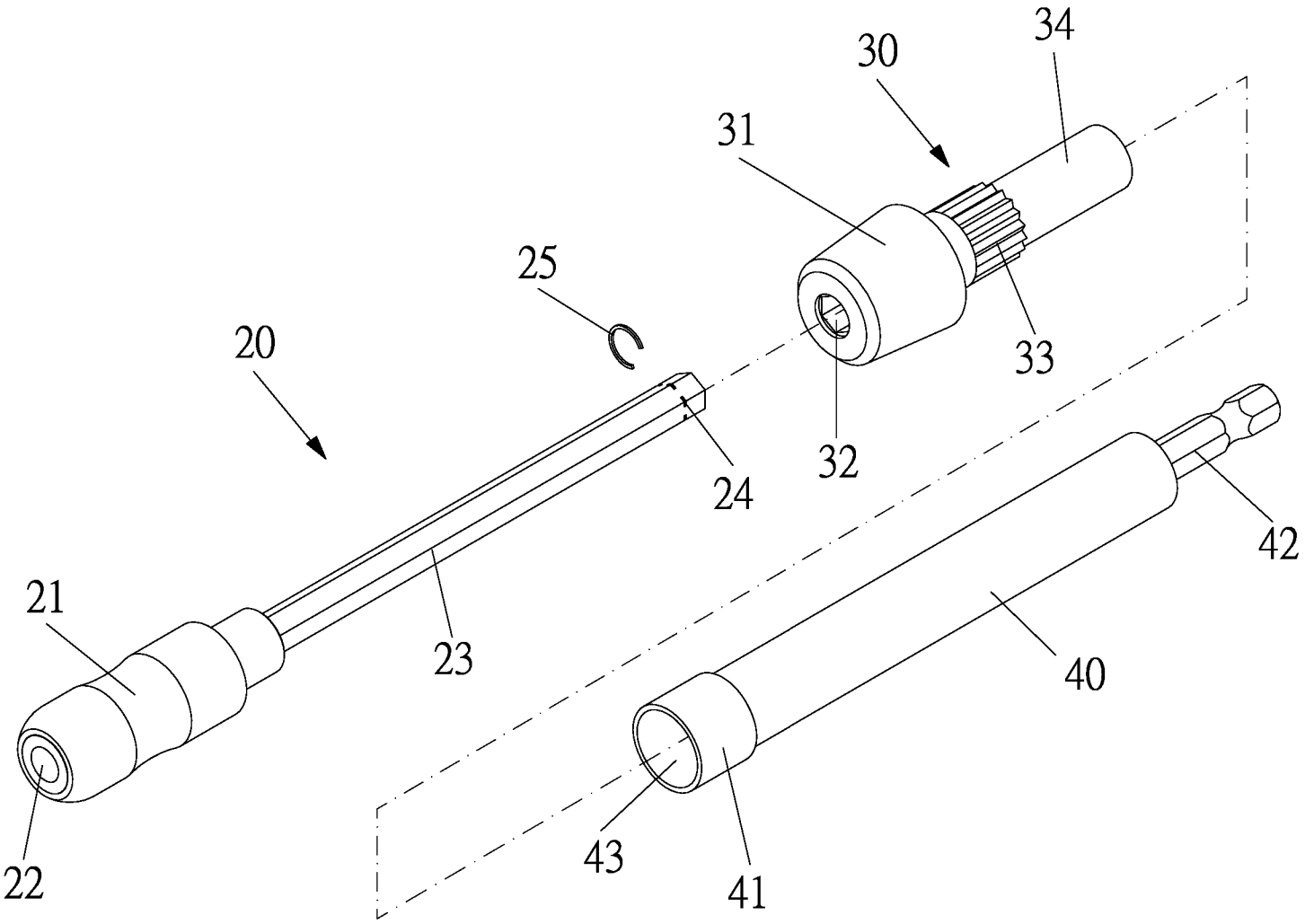
FIG. 2 is a perspective view showing the exploded components of the length adjustable connection structure according to the preferred embodiment of the present invention.
Figure 3:
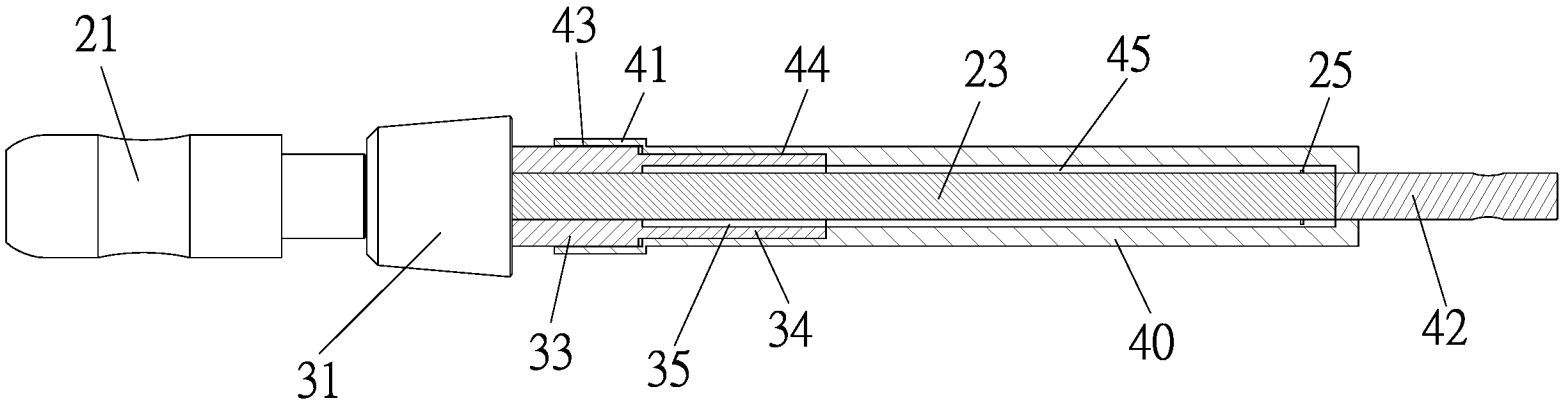
FIG. 3 is a cross sectional view showing the assembly of the length adjustable connection structure according to the preferred embodiment of the present invention.

With reference to FIGS. 1-3, a length adjustable connection structure 10 according to a preferred embodiment of the present invention comprises: an adjustment assembly 20, an engagement assembly 30, and a receiving tube 40.

The receiving tube 40 includes an insertion 42 accommodated in a first end thereof, a coupling portion 41 formed on a second end of the receiving tube 40 and having a diameter more than a diameter of the receiving tube 40, a groove 43 defined in the coupling portion 41, a trench 44 extending in the groove 43 and away from the coupling portion 41, and an elongated slot 45 defined in the trench 44, wherein a first stepped shoulder is defined between the groove 43 and the trench 44, and a second stepped shoulder is defined between the trench 44 and the elongated slot 45, wherein a diameter of the groove 43 is more than a diameter of the trench 44, and a diameter of the trench 44 is more than a diameter of the elongated slot 45.

The engagement assembly 30 includes a fixing portion 31 formed on a first end thereof, a toothed portion 33 adjacent to the fixing portion 31, a fitting portion 34 formed on a second end of the engagement assembly 30 away from the fixing portion 31, a hexagonal hole 32 extending from the fixing portion 31, and a circular hole 35 extending from the hexagonal hole 32 to the fitting portion 34, wherein a diameter of the fixing portion 31 is more than a diameter of the toothed portion 33, and the diameter of the toothed portion 33 is more than a diameter of the fitting portion 34.

The adjustment assembly 20 includes a connector 21, a locating orifice 22 defined in the connector 21, a hexagonal column 23 extending away from the connector 21, a notch 24 surrounding an outer end of the hexagonal column 23, and a C-retainer 25 engaged in the notch 24.

In assembly, the hexagonal column 23 of the adjustment assembly 20 is received in the hexagonal hole 32 of the engagement assembly 30 so that the engagement assembly 30 is connected on the hexagonal column 23, the C-retainer 25 is engaged in the notch 24 of the hexagonal column 23, and the adjustment assembly 20 and the engagement assembly 30 are accommodated in the receiving tube 40, hence the toothed portion 33 of the fixing portion 31 is engaged in the groove 43 of the coupling portion 41, and the fitting portion 34 is fixed in the trench 44, thus connecting the adjustment assembly 20, the engagement assembly 30, and the receiving tube 40.

Figure 4:
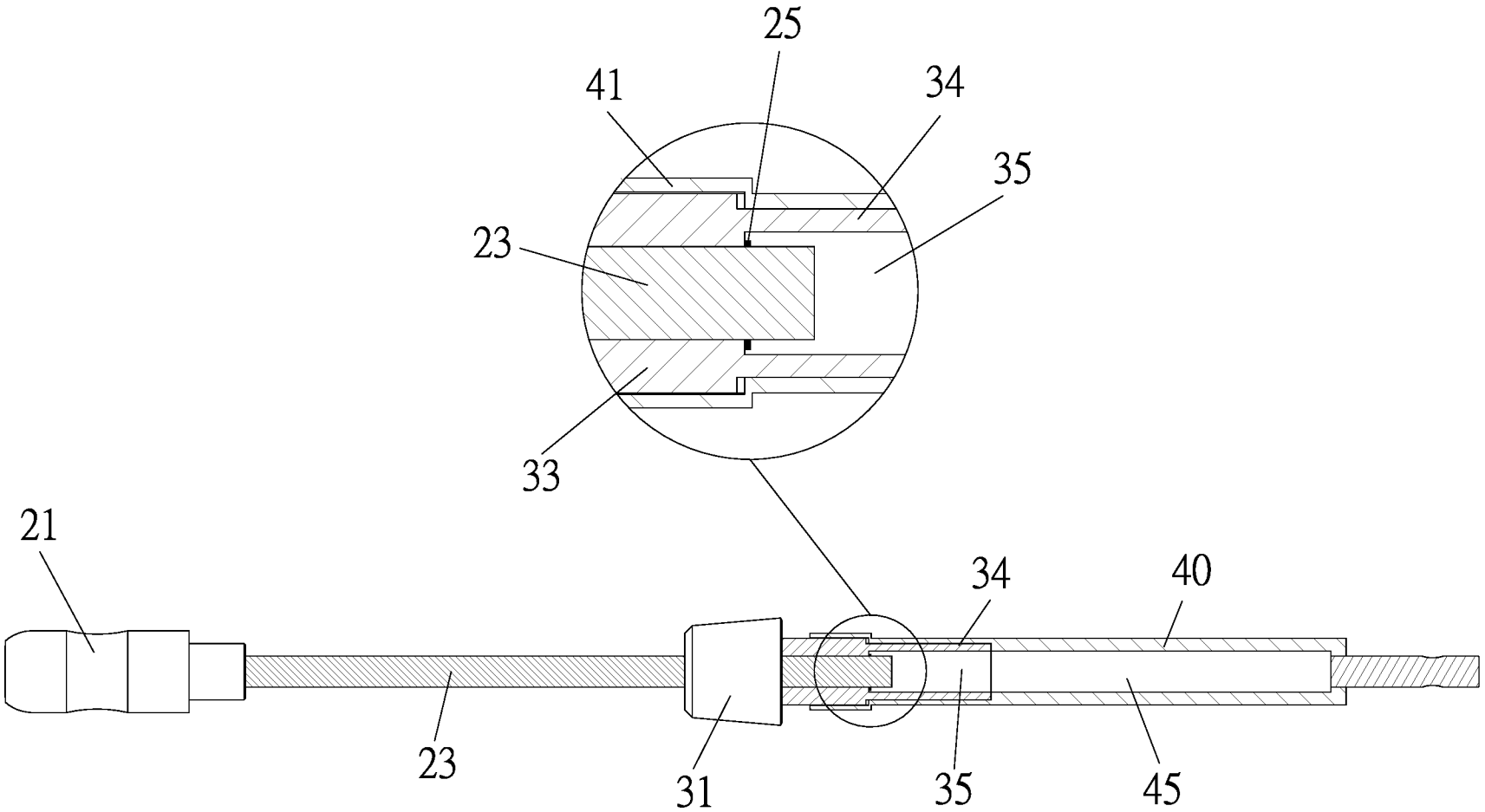
FIG. 4 is a cross sectional view showing the operation of the length adjustable connection structure according to the preferred embodiment of the present invention.

Referring to FIG. 4, when the fixing portion 31 is driven manually by a user to remove the hexagonal column 23 from the circular hole 35 and the elongated slot 45, the adjustment assembly 20 is movable, for example, when the hexagonal column 23 is extended, the C-retainer 25 is engaged in the circular hole 35 of the engagement assembly 30, thus extending the adjustment assembly 20 in a maximum length.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A length adjustable connection structure comprising: an adjustment assembly, an engagement assembly, and a receiving tube;

wherein the receiving tube including an insertion accommodated in a first end thereof, a coupling portion formed on a second end of the receiving tube and having a diameter more than a diameter of the receiving tube, a groove defined in the coupling portion, a trench extending in the groove and away from the coupling portion, and an elongated slot defined in the trench;

wherein the engagement assembly includes a fixing portion formed on a first end thereof, a toothed portion adjacent to the fixing portion, a fitting portion formed on a second end of the engagement assembly away from the fixing portion, a hexagonal hole extending from the fixing portion, and a circular hole extending from the hexagonal hole to the fitting portion, wherein a diameter of the fixing portion is more than a diameter of the toothed portion, and the diameter of the toothed portion is more than a diameter of the fitting portion;

wherein the adjustment assembly includes a connector, a locating orifice defined in the connector, a hexagonal column extending away from the connector, a notch surrounding an outer end of the hexagonal column, and a C-retainer engaged in the notch;

wherein the hexagonal column of the adjustment assembly is received in the hexagonal hole of the engagement assembly so that the engagement assembly is connected on the hexagonal column, the C-retainer is engaged in the notch of the hexagonal column, and the adjustment assembly and the engagement assembly are accommodated in the receiving tube, hence the toothed portion of the fixing portion is engaged in the groove of the coupling portion, and the fitting portion is fixed in the trench, thus connecting the adjustment assembly, the engagement assembly, and the receiving tube.

2. The length adjustable connection structure as claimed in claim 1, wherein when the fixing portion is driven manually to remove the hexagonal column from the circular hole and the elongated slot, the adjustment assembly is movable with respect to the engagement assembly and a receiving tube.

3. The length adjustable connection structure as claimed in claim 1, wherein when the hexagonal column is extended, the C-retainer is engaged in the circular hole of the engagement assembly, thus extending the adjustment assembly in a maximum length.

4. The length adjustable connection structure as claimed in claim 1, wherein a first stepped shoulder is defined between the groove and the trench, and a second stepped shoulder is defined between the trench and the elongated slot, wherein a diameter of the groove is more than a diameter of the trench, and a diameter of the trench is more than a diameter of the elongated slot.

* * * * *